US005563696A

United States Patent [19]

Futagawa et al.

[11] Patent Number: 5,563,696

[45] Date of Patent: Oct. 8, 1996

[54] IMAGE FIXING APPARATUS WITH POWER CONTROL DURING SHEET PASSAGE

[75] Inventors: Jiro Futagawa; Hirohisa Sawada, both of Kawasaki; Shigeo Miura, Tokyo, all of Japan

[73] Assignee: Canon Kabushiki Kaisha, Tokyo, Japan

[21] Appl. No.: 565,084

[22] Filed: Nov. 30, 1995

Related U.S. Application Data

[63] Continuation of Ser. No. 250,499, May 27, 1994, abandoned.

[30] Foreign Application Priority Data

May 27, 1993 [JP] Japan ..... 5-126172

[51] Int. Cl.[6] ..... G03G 15/20

[52] U.S. Cl. ..... 355/285; 355/208; 355/290

[58] Field of Search ..... 355/203, 208, 355/282, 285, 289, 290; 219/216; 118/60

[56] References Cited

U.S. PATENT DOCUMENTS 5,109,255 4/1992 Nishikawa et al. ..... 355/285

5,164,570 11/1992 Okimura ..... 219/216

5,300,996 4/1994 Yokoyama et al. ..... 355/285

5,327,202 7/1994 Nami et al. ..... 355/282

5,345,301 9/1994 Satoh et al. ..... 355/290

5,365,314 11/1994 Okuda et al. ..... 355/208

*Primary Examiner*—Sandra L. Brase

*Attorney, Agent, or Firm*—Fitzpatrick, Cella, Harper & Scinto

[57] ABSTRACT

An image fixing apparatus includes a heater; a detector for detecting a temperature of the heater; a controller for controlling electric power supply to the heater to provide a predetermined constant temperature detected by the detector; a rotatable member heated by the heater; a pressing member cooperable with the rotatable member to form a nip through which a recording material is passed through; and wherein the controller is capable of switching the predetermined temperature during one recording material is being passed through the nip.

25 Claims, 5 Drawing Sheets

IMAGE FIXING APPARATUS WITH POWER CONTROL DURING SHEET PASSAGE

This application is a continuation of application Ser. No. 08/250,499, filed May 27, 1994 now abandoned.

FIELD OF THE INVENTION AND RELATED ART

The present invention relates to an image fixing apparatus for heat-fixing an unfixed image on a recording material, usable with an image forming apparatus such as a copying machine, printer or the like.

In an image forming apparatus such as a copying machine, an image fixing device is used in which a recording material carrying an unfixed toner image is passed through a nip formed between a rotatable member and a pressing member, and the image is fixed by application of heat. In such an image fixing device, the fixing property is maintained in many cases by constant temperature control for the rotatable member contactable with the unfixed toner image or of a heating member.

Referring to FIG. 3, there is shown an example of such an image fixing device, which is of a film heating type, wherein a constant temperature control is effected for the heater.

In the Figure, reference numeral 1 designates a ceramic heater; 2 is a rotatable fixing film press-contacted to the ceramic heater 1 to fix the toner image formed on the recording material 3; 4 is a pressing roller for urging the recording material 3 and the fixing film 2 toward the heater 1. At a position where the pressing roller 4 and the fixing film 2 are press-contacted, the toner on the recording material 3 is fixed on the recording material. The recording material 3 is guided by a guiding member 5 to the contact position 6 (nip) between the pressing roller 4 and the fixing film 2, and is heated by the heater 1 to fix the tuner image on the recording material.

The temperature of the heater is controlled, using a thermistor 7 bonded by bonding material or grease or the like of high thermal conductivity, on a backside of the heater 1. The fixing film 2 is guided by a guiding member 8 so as to permit smooth rotation of the fixing film.

In the Figure, rotation of the fixing film 1 and the movement of the recording material 3 are effected by the pressing roller 4. The pressing roller 4 is rotated by an unshown driving source. Because of the press-contact between the pressing roller 4 toward the heater 1 surface, the fixing film 2 is rotated by the rotation of the pressing roller 4.

The fixed recording material 3 is fed to a discharging roller 10 by a guiding member 9 to the outside of the apparatus.

The description will be made as to the control of the heater 1. The heater 1 is normally in the off-state, and is rendered on upon instruction of the printing. The heater 1 is directly pressed on the nip through a thin PI film having a thickness of approx. 60 μm, and therefore, the heat transfer efficiency is high, such that from the initial off-state, 10–20 sec. approx. is enough to the operable state reached. The heater is supplied with an AC voltage, and the AC voltage is controlled on the basis of the temperature detected by a thermister 7 on the backside of the heater. When the heater 1 reaches a target temperature $T_{A0}$, the energy supply is stopped. Thereafter, when the temperature of the heater decreases below the target temperature $T_{A0}$ because of the heating operation, heat absorbing of the recording material 3 and the heat absorbing by the pressing roller 4, the energy supply is resumed toward the target temperature. Such operations are repeated to maintain a constant heater temperature.

However, even if the heater temperature is maintained constant during the fixing operation on the recording material which is being passed through the nip, the surface temperature of the pressing roller 4 gradually decreases because of the existence of the paper in the nip. The fixing property of the toner image is dependent on the temperature at the nip. When the surface temperature of the pressing roller gradually decreases during the sheet passage, the temperature in the nip decreases with the result of improper fixing.

This wall be described in more detail referring to FIG. 4.

In this Figure, reference numeral 11 designates a heater temperature $T_A$ controlled by the thermistor 7; 12 is a pressing roller temperature $T_B$; and 13 is a nip temperature $T_C$. The nip temperature $T_C$ is lower than the heater temperature $T_A$ by $\Delta T_1$ because the thermal energy is taken by the moving fixing film 2 and the pressing roller. During the sheet passage, even if the heater temperature $T_A$ is constant, the nip temperature decreases by $\Delta T_2$ at the maximum because of the heat flow to the recording sheet 3 from the film and the pressing roller 4. By the temperature decrease, the toner fixing on the recording material 3 becomes insufficient with the result of possible non-uniform fixing or improper fixing.

In order to prevent the improper fixing due to the insufficient temperature, the heater temperature $T_A$ may be increased from the beginning in consideration of the temperature decrease $\Delta T_2$. In this case, however, unnecessary heating is required as shown in FIG. 5 with the result of increased energy consumption. In addition, the increase by $\Delta T_2$ results in a portion where the toner is heater too much, with the possible liability of deposition of the toner on the film 1 surface. Furthermore, outside the sheet passage area, that is, a lateral portion or portions, the heat is not taken by the sheet or the pressing roller, and Therefore, the temperature increase continues. For this reason, the heat resistivity and/or the durability of the pressing roller is insufficient. In order to assure the parting property, the surfaces of the fixing film of the pressing roller are generally coated with fluorine resin material or the like. The heat resistivity of the coating material may De insufficient, and then, the contamination of the film surface or the pressing roller surface is a problem. In such a case, the recording sheet may adhere to the pressing roller with the result of jam.

As will be understood from the foregoing, if the nip temperature decreases during sheet passage period, the constant temperature control for the heater alone is not enough.

SUMMARY OF THE INVENTION

Accordingly, it is a principal object of the present invention to provide an image fixing apparatus in which the nip temperature decrease during the sheet passage is prevented.

According to an aspect of the present invention, there is provided an image fixing apparatus comprising: a heater; detecting means for detecting a temperature of the heater: control means for controlling electric power supply to the heater to provide a predetermined constant temperature detected by the detecting means; a rotatable member heated by the heater; a pressing member cooperable with the rotatable member to form a nip through which a recording material is passed through; and wherein the control means is capable of switching the predetermined temperature during one recording material is being passed through the nip.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
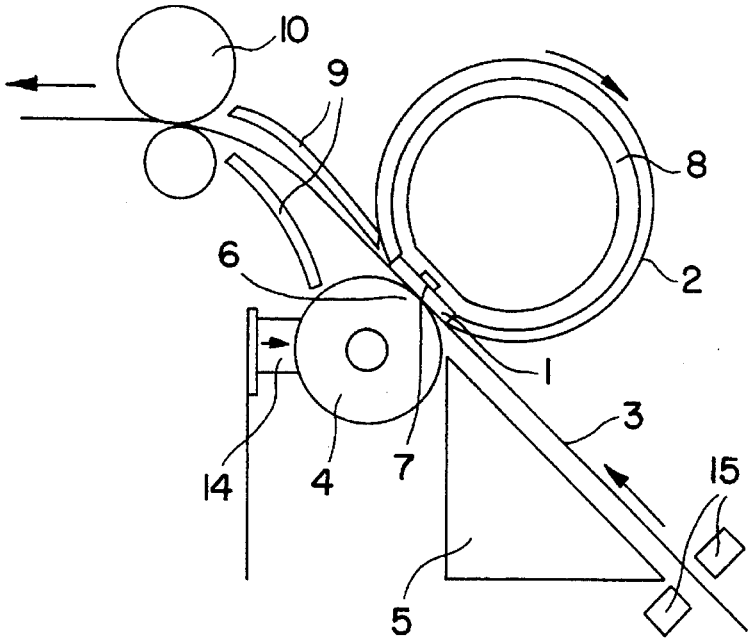
FIG. 1 is a sectional view of an image fixing apparatus according to a first embodiment of the present invention.
Figure 3:
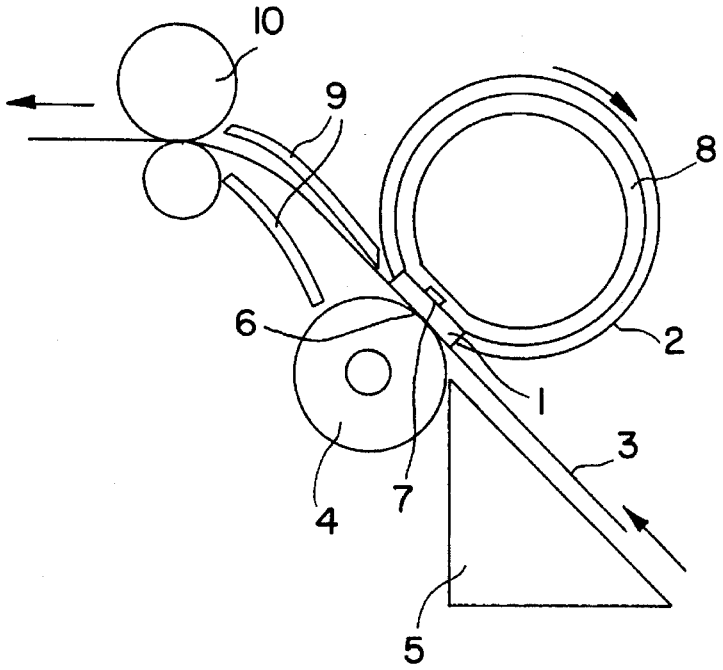
FIG. 3 is a sectional view of a conventional fixing device.
Figure 4:
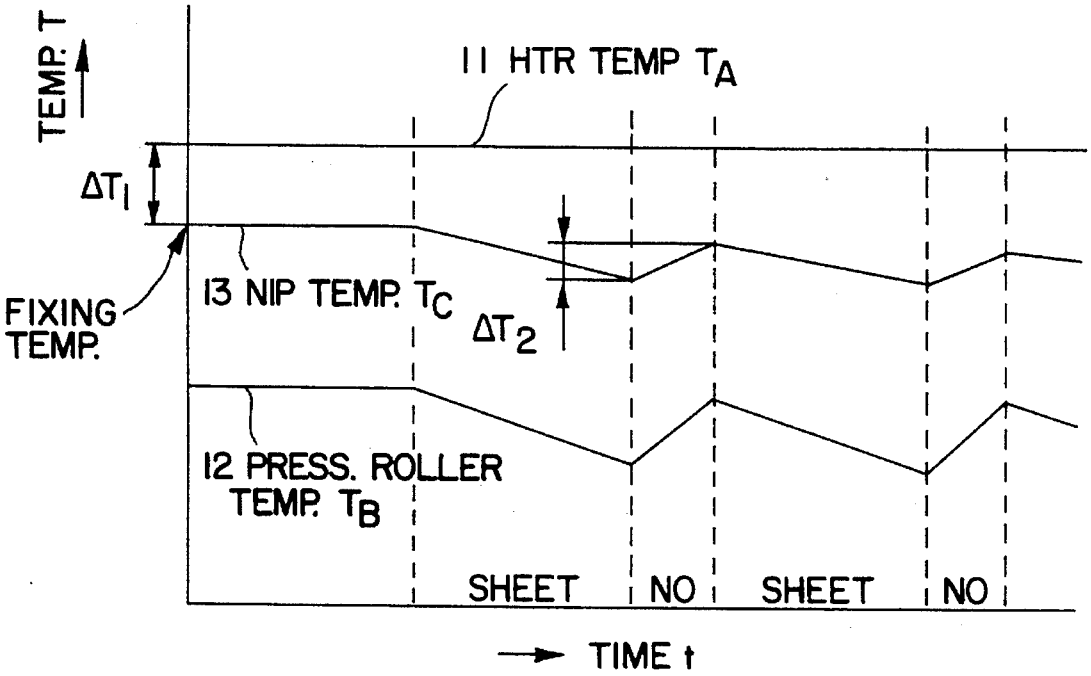
FIG. 4 illustrates the temperature control for the heater in the conventional example of FIG. 3.
Figure 5:
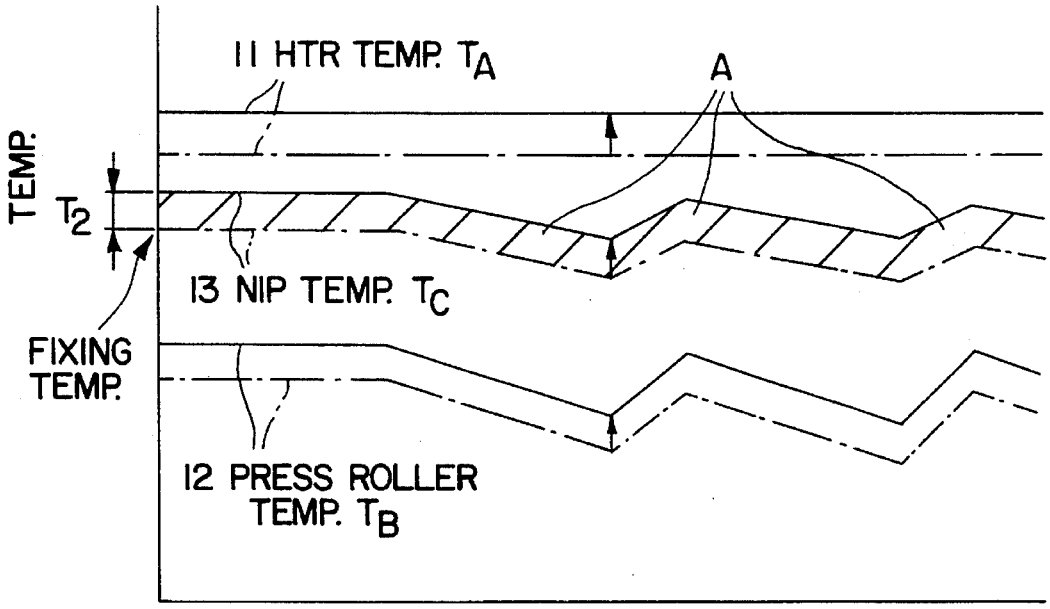
FIG. 5 illustrates the temperature control for the conventional heater shown in FIG. 3.

Referring to FIG. 1, there is shown an image fixing apparatus. In this Figure, the same reference numerals as in FIG. 3 are assigned to the elements having the corresponding functions.

In this embodiment, a thermistor 14 is provided to detect the temperature of the pressing roller 4. Upstream of the guiding member 5, detecting means 15 for measuring the thickness of the recording sheet 3 is provided. The thickness detecting means 15 detects the thickness by measuring electrostatic capacity during the sheet passage. The material of the sheet has been transmitted to the CPU for controlling the fixing station on the basis of key input by the operator on the operation panel (not shown), by which the operator inputs whether the material is OHP, post card, reproduced paper or the like. The sheet supply is started with the material information having been inputted. When the material passes by the thickness detecting means 15, the thickness is measured, and the detected information is transmitted to the CPU for the fixing operation control. After the thickness is measured, the recording material 3 reaches the nip, and then, the fixing operation is started. The degree of temperature decrease of the pressing roller by the recording sheet 3 is detected by the pressing roller thermister 14. The control of the fixing operation will be described in detail.

Figure 2:
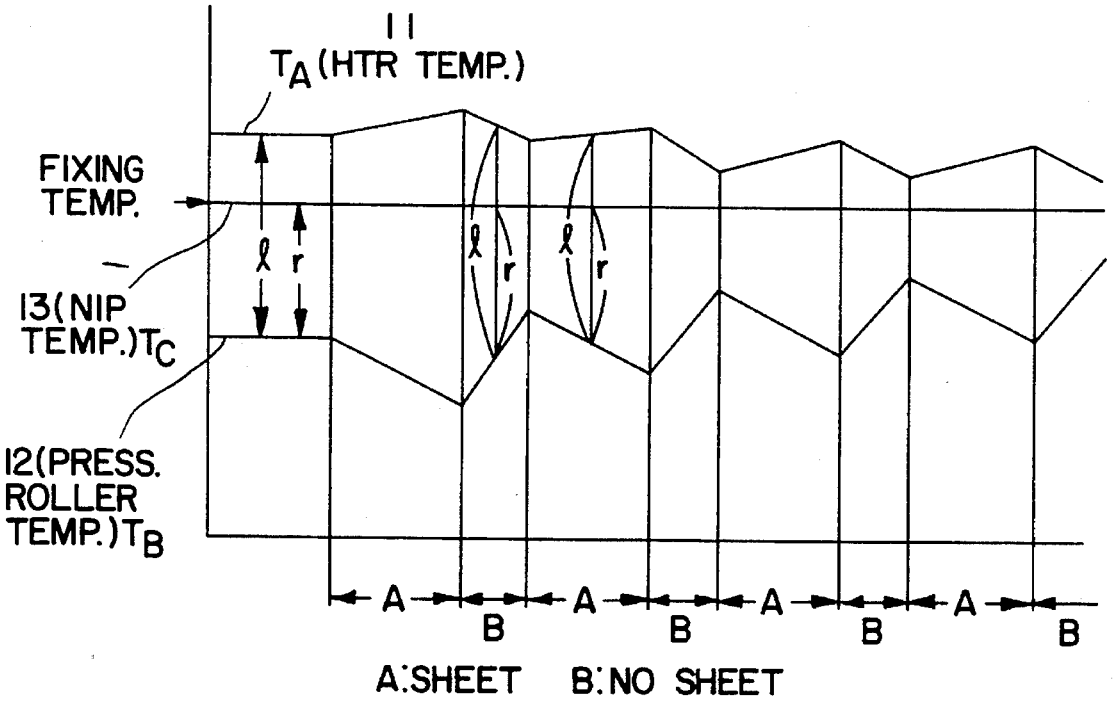
FIG. 2 illustrates a temperature control for an image fixing heater.

In the apparatus shown in FIG. 1, where the recording material carrying the unfixed toner image is fed by the film 2 and the pressing roller 4, while the image is being heat-fixed, the temperature $T_C$ at the nip is dependent on the heater temperature $T_A$ and the pressing roller temperature $T_B$. If the nip temperature $T_C$ Is constant, the ratio of the temperature difference between the heater temperature $T_A$ and the pressing roller temperature $T_B$ and the temperature difference between the nip temperature $T_C$ and the pressing roller temperature $T_B$ (FIG. 2). In other words, $$(T_C-T_B)/T_A-T_B=\tau(\text{constant}) \quad (1)$$

Using this, the pressing roller temperature $T_B$ is detected first in this embodiment, the heater temperature $T_A$ is determined on the basis of the pressing roller temperature $T_B$ so as to provide the nip temperature $T_C$.

More particularly, the following equation resulting from equation (1) is used:

$$T_A=[T_C-(1-\tau)T_B]/\tau \quad (2)$$

The heater is supplied with the electric energy the target temperature of $T_A$.

Here, the value $\tau$ is dependent on the thermal capacity and the thermal capacities and thermal conductivities of the parts constituting the fixing station and on the position of the thermistor or the like, and therefore it is properly determined by one skilled in the art. In this embodiment, $\tau$ is approx. 0.75. For example, in order to maintain a temperature of 180° C. in the nip, the heater temperature is changed as shown in Table 1 using equation (2) in accordance with the temperature of the pressing roller which decreases with sheets passed through the nip.

TABLE 1

| Processing roller temp. $T_B$ | Calculations | Heater temp. $T_{A0}$ |
|---|---|---|
| 80 | $\frac{180-(1-0.75)\times 80}{0.75}$ | 213.3 |
| 100 | $\frac{180-(1-0.75)\times 100}{0.75}$ | 206.7 |
| 120 | $\frac{180-(1-0.75)\times 120}{0.75}$ | 200.0 |

In this manner, the heater temperature $T_A$ (target temperature $T_{A0}$) is determined on the basis of the pressing roller temperature $T_B$ during one sheet passage, and the heater is supplied with electric energy so as to provide the target temperature. It is discriminated whether the temperature reaches the target temperature $T_{A0}$ or not, by the thermister 7 mounted on the back side of the heater.

In this embodiment, the target temperature $T_{A0}$ is calculated for every 0.1 sec. for the pressing roller temperature $T_B$, and is changed thereby. Thus, the sampling time period is shorter than the time period required for the recording material passing through the nip. The required sampling period changes depending on the structure of the fixing device. Using shorter sampling period, the temperature control accuracy is improved.

The similar control is effected to stabilize the nip temperature in addition to the sheet passage period (A) in FIG. 2, also during sheet interval during which the sheet is absent at the nip (B). When the next recording sheet is supplied to the fixing device, the proper fixing condition is immediately achieved. In addition, wasteful heating or temperature increase during the sheet interval (B) can be avoided.

In addition, in this embodiment, the fixing temperature (nip temperature $T_C$) is changed depending on the recording material thickness or the material thereof. More particularly, when the thickness is small, the energy required for heating the recording material is low, and therefore, the nip temperature $T_C$ is set at a slightly lower level. On the contrary, is thick, the nip temperature $T_C$ is set at a slightly higher level. In the case of the material such as OHP or bond paper, for which the fixing operation is difficult because of the special surface property thereof, the fixing temperature $T_C$ is set at a higher level on the basis of the information already inputted. More particularly, by changing the nip temperature $T_C$ in the equation (2), the target temperature $T_{A0}$ is changed.

By doing so, the stabilized fixing performance can be provided respective of the thickness of the sheet or the material thereof.

Figure 6:
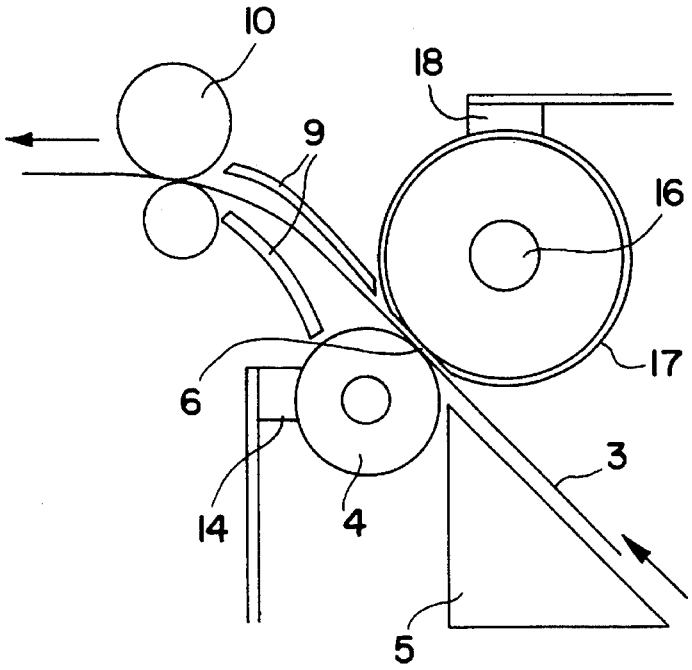
FIG. 6 illustrates an image fixing apparatus according to a second embodiment of the present invention.

Referring to FIG. 6, there is shown an image fixing apparatus according to e second embodiment of the present invention. In this embodiment, an aluminum tube 17 is used in place of the film. The electric energy supply to the heater is controlled on the basis of the temperature of the aluminum tube by the thermistor 18 so as to provide a constant aluminum tube temperature 17. Similarly to the first embodiment, the temperature of the pressing roller 4 is detected by the thermistor 14, and in response to the detected temperature, the target temperature for the aluminum tube 17 is changed during the sheet passage through the nip.

In the case of the small thickness tube (not less than 1.5 mm, for example), the thermal capacity of the aluminum tube decreases with the result of larger temperature change of the nip due to the heat absorption of the recording material. Therefore, the heater temperature control during the sheet passage described above is effective.

A third embodiment of the present invention will be described.

Figure 7:
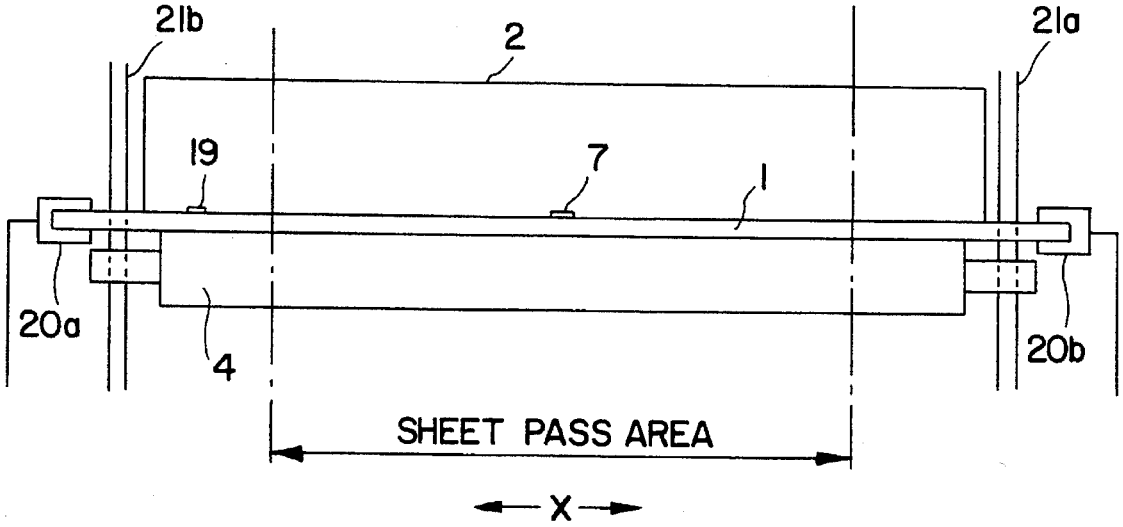
FIG. 7 is a side view of an image fixing device according to a third embodiment of the present invention.

In the foregoing first and second embodiments, the switching of the set temperature during the sheet passage, is effected in accordance with the temperature change of the pressing roller. As shown in FIG. 7, a thermistor 17 is additionally provided outside the longitudinal sheet passage region of the heater, the nip temperature $T_C$ during the sheet passage is predicted, and the control is carried out using this.

In FIG. 7, a thermistor 19 is disposed adjacent the sheet passage region. A lateral stop **21*b* functions to stop the film 2 against lateral shifting (X direction in the Figure) and also functions as supporting member for the pressing roller and the heater 1. Electric contacts 20*a* and 20*b* function to supply an AC voltage to the heater 1**.

Figure 8:
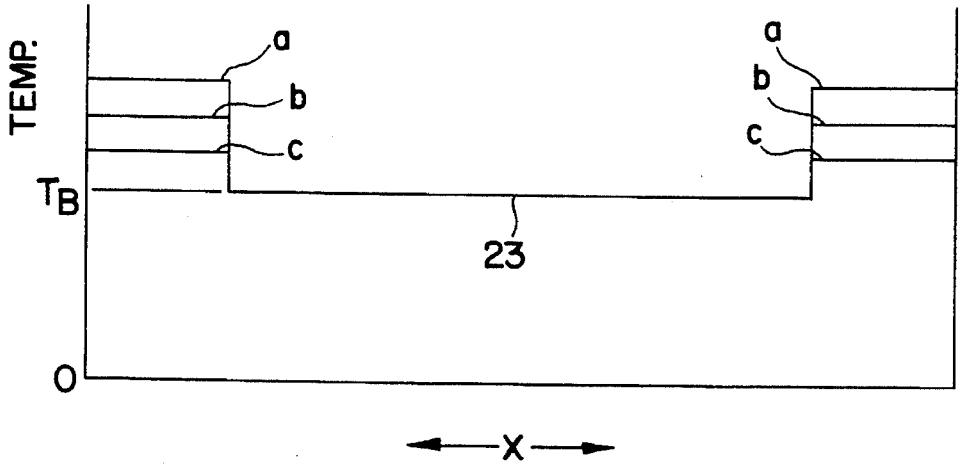
FIG. 8 illustrates temperature rise in the non-sheet area.

As described in the foregoing, during the sheet passage, the heat is removed from the heater by the recording sheet 3. Particularly, in the case of the continuous image fixing operation, the quantity of heat removed by the recording material is larger than the quantity of the heat supplied from the heater. Therefore, the electric energy (W) is increased on the basis of the temperature detection of the thermister 7, by which the constant temperature is maintained. As a result, as shown in FIG. 8, in the sheet non-passage region, the heater temperature increases because of the absence of the heat absorption of the recording material. The degree of the temperature rise is dependent on the thickness of the recording sheet or the number of continuous fixing operations or the like, such that the electric energy supplied increases with increase of the number of continuous fixing operations and increase of the quantity of heat absorption by the recording material, and therefore, the, temperature increases in the manner shown by a, b and c.

Using the difference in the temperature increase of the non-passage area dependent on the material of the sheet or the number of continuous fixing operations, the heater temperature during the sheet passage is controlled in accordance with the temperature rise in the non-sheet passage region.

Figure 9:
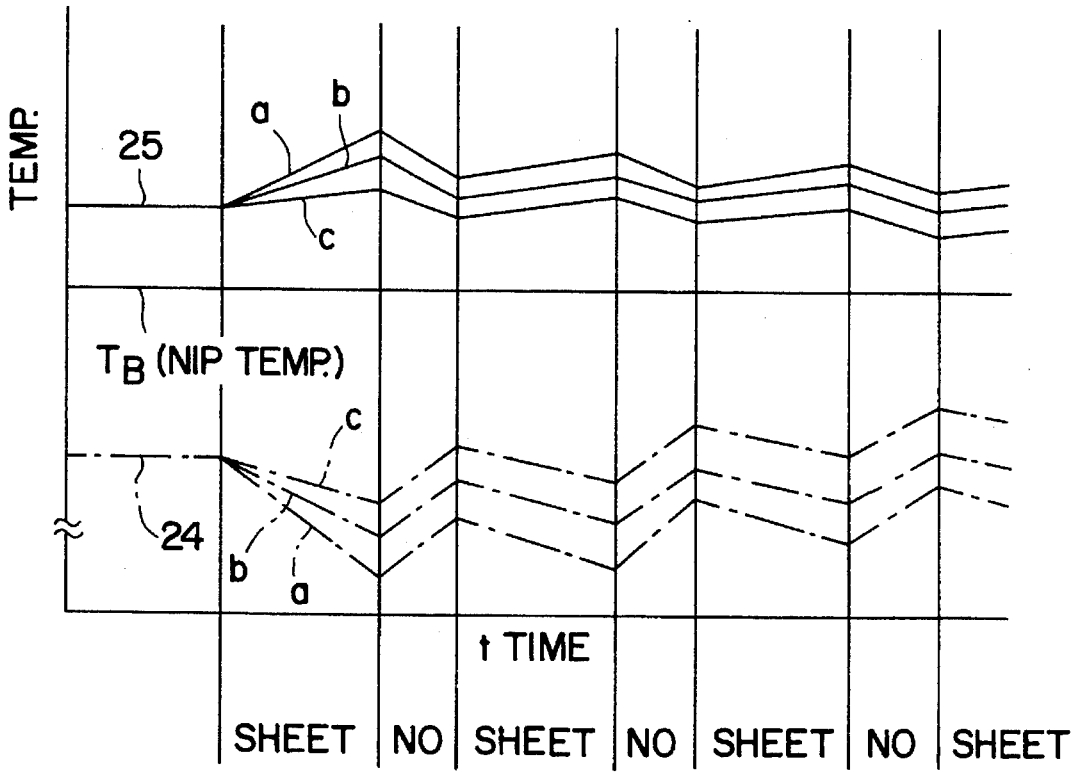
FIG. 9 illustrates a heater temperature control in the apparatus of FIG. 7.

Here, as shown in FIG. 9, the temperature decrease of the pressing roller during the sheet passage for the material a, b or c, are determined through experiments beforehand (chain line in FIG. 9). On the basis of the data, the target temperature of the heater is calculated by equation (2), and the temperature diagram 25 (solid line in FIG. 9) is produced. The information is stored in the CPU. For example, when the temperature of the non-passage region increases to the temperature C shown in FIG. 8, the heater target temperatures during the sheet passage and the sheet interval, are switched as indicated by a solid line C in FIG. 9. When the temperature of the non-passage region increases to the temperature a shown in FIG. 8, the heater target temperatures during the sheet passage and the sheet interval are controlled as indicated by a solid line a in FIG. 9.

In the third embodiment, the thermistor is disposed on the backside of the heater in the non-passage area, and therefore, the thermistor is substantially free from the problem of contamination.

In the embodiment described in the foregoing, on the temperature control during the sheet passage is carried out, using two thermistors. In the image fixing system using the fixing roller, one thermister is disposed on the surface of the tube in the sheet passage region, and the similar temperature control for the heater is effected on the basis of the temperature decrease of the aluminum tube due to the recording material passage, as an alternative.

In the first and second embodiments, the heater temperature is determined on the basis of the information from the pressing roller, using $$T_A=[T_B-(1-\tau)T_C]/\tau \quad (2)$$

The determination of the temperature may be determined in another manner. For example, a table may be stored in a memory to effect stepwise control, not using the equation, provided that the heater temperature control is carried out taking the heat absorption of the recording material into account during the sheet passage period. Additionally, if there is temperature margin as in the case of thin sheet, the temperature control during the sheet passage may not be carried out.

As for the sheet thickness detecting means, electrostatic capacity is used, but the pressing roller thermistor 14 may be used in place thereof. More particularly, using the fact that the temperature decrease of the pressing roller during the sheet passage is dependent on the thickness of the recording sheet, the thickness of the sheet is predicted. On the basis of the prediction, the nip temperature $T_C$ may be changed. Further particularly, when the temperature decrease of the pressing roller is large, the thickness of the sheet is predicted as being large, so that the temperature $T_C$ is increased. If it is small, the sheet is predicted as being a thin sheet, and therefore, the nip temperature $T_C$ is lowered.

In addition, as in the third embodiment, the temperature $T_C$ may be changed depending on the temperature rise in the non-sheet passage region. In these cases, the necessity for the additional thickness detecting means is eliminated, so that the cost can be reduced.

As for the means for detecting the material of the sheet, the key board operable by the user is used. However, another method is usable. For example, the material may be automatically detected on the basis of, electrostatic capacity, light reflection rate using LED and/or photosensor, weight, size, thickness or the like, in combination or individually. In this case, failure of the operator erroneous setting of the operator or the cumbersome operation can be avoided.

As described in the foregoing, according to the present invention, the temperature control of the heater is effected so as to correct the temperature change of the nip due to the heat absorption of the recording material during the sheet passage, by which the constant nip temperature can be maintained. Thus, the improper fixing or non-uniform fixing can be prevented. In addition, unnecessary heating can be prevented, so that the electric energy consumption required is decreased. Additionally, the influence of the temperature rise to the photosensitive drum or the like can be avoided. Moreover, the required heat resistivity is lowered with the result of increased service life of the pressing roller or the coating, and in addition, contamination with toner due to the deterioration of the parting properly and the sticking of the sheet to the pressing roller (jam) or the like can be prevented.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a heating member;

a back-up member cooperable with said heating member to form a nip through which a recording material passes;

temperature detecting means for detecting a temperature of said heating member; and control means for controlling electric power supply to said heating member so that the temperature detected by said temperature detecting means is maintained at a predetermined fixing temperature, said control means switching the predetermined fixing temperature as the recording material passes through the nip.

2. An apparatus according to claim 1, further comprising second temperature detecting means for detecting a temperature of said back-up member, wherein said control means switches the predetermined fixing temperature on the basis of an output of said second temperature detecting means.

3. An apparatus according to claim 2, wherein said second temperature detecting means detects the temperature of said back-up member at predetermined time intervals.

4. An apparatus according to claim 1, further comprising a non-passage temperature detecting means for detecting a temperature of said heating member in a sheet-non-passage region, wherein said control means switches the predetermined fixing temperature on the basis of an output of said non-passage temperature detecting means.

5. An apparatus according to claim 1, wherein said heating member includes a heater generating heat upon electric energy supply thereto and a film moveable in contact with said heater and together with the recording material.

6. An apparatus according to claim 5, wherein said temperature detecting means detects the temperature of said heater.

7. An apparatus according to claim 1, wherein said heating member includes a heater generating heat upon electric energy supply thereto and a fixing roller heated by said heater.

8. An apparatus according to claim 7, wherein said temperature detecting means detects the temperature of said fixing roller.

9. An apparatus according to claim 1, wherein said back-up member comprises an elastic roller.

10. An image fixing apparatus, comprising:

a heating member;

a back-up member cooperable with said heating member to form a nip through which a recording material passes;

first temperature detecting means for detecting a temperature of said heating member;

second temperature detecting means for detecting a temperature of said back-up member;

control means for controlling electric power supply to said heating member so that the temperature detected by said first temperature detecting means is maintained at a target temperature, said control means switching the target temperature in accordance with the detected temperature of said second temperature detecting means.

11. An apparatus according to claim 10, wherein said second temperature detecting means detects the temperature of said back-up member at predetermined time intervals.

12. An apparatus according to claim 10, wherein said heating member includes a heater generating heat upon electric energy supply thereto and a film moveable in contact with said heater and together with the recording material.

13. An apparatus according to claim 12, wherein said first temperature detecting means detects the temperature of said heater.

14. An apparatus according to claim 10, wherein said heating member includes a heater generating heat upon electric energy supply thereto and a fixing roller heated by said heater.

15. An apparatus according to claim 14, wherein said first temperature detecting means detects the temperature of said fixing roller.

16. An apparatus according to claim 10, wherein said back-up member comprises an elastic roller.

17. An image fixing apparatus, comprising:

a heating member;

a back-up member cooperable with said heating member to form a nip through which a recording material passes;

first temperature detecting element for detecting a temperature of said heating member, wherein said first temperature detecting element is disposed in a sheet passing area in a longitudinal direction of said heating member;

second temperature detecting element for detecting a temperature of said heating member, said second temperature detecting element being disposed outside the sheet passing area in a longitudinal direction of said heating member; and control means for controlling electric power supply to said heating member so that the temperature detected by said first temperature detecting element is maintained at a target temperature, said control means switching the target temperature in accordance with the detected temperature of said second temperature detecting element.

18. An apparatus according to claim 17, wherein said control means controls the electric power supply in accordance with both of the detected temperature of said second temperature detecting element and a kind of the recording material.

19. An apparatus according to claim 17, wherein said control means controls the electric power supply in accordance with both of the detected temperature of said second temperature detecting element and a size of the recording material.

20. An apparatus according to claim 17, wherein said control means controls the electric power supply in accordance with both of the detected temperature of said second temperature detecting element and an integrated number in continuous fixing operations.

21. An apparatus according to claim 17, wherein said heating member includes a heater generating heat upon electric energy supply thereto and a film movable in contact with said heater and together with the recording material.

22. An apparatus according to claim 17, wherein said first and second temperature detecting elements detects the temperature of said heater.

23. An apparatus according to claim 17, wherein said heating member includes a heater generating heat upon electric energy supply thereto and a fixing roller heated by said heater.

24. An apparatus according to claim 17, wherein said first and second temperature detecting elements detects the temperature of said fixing roller.

25. An apparatus according to claim 17, wherein said back-up member comprises an elastic roller.

* * * * *

UNITED STATES PATENT AND TRADEMARK OFFICE

CERTIFICATE OF CORRECTION

PATENT NO. : 5,563,696

DATED : October 8, 1996

INVENTOR(S) : JIRO FUTAGAWA, ET AL.

It is certified that error appears in the above-indentified patent and that said Letters Patent is hereby corrected as shown below:

Column 57 (Abstract),
line 11, "during one" should read --as the--.
Column 1,
line 36, "tuner" should read --toner--;
line 38, "heater" should read --heater 1--; and
line 63, "thermister" should read --thermistor--.
Column 2,
line 15, "wall" should read --will--;
line 35, "heater" should read --heated--;
line 39, "Therefore," should read --therefore,--; and
line 45, "De" should read --be--.
Column 3,
line 1, "during" should read --as the--;
line 2, "one" should be deleted; and
line 61, "Is" should read --is--.
Column 4,
line 9, "energy" should read --energy with--;
line 46, "Using" should read --Using a--;
line 48, "The similar" should read --Similar--; and
line 61, "is" (first occurrence) should read --if--.
Column 5,
line 5, "e" should read --a--;
line 52, "the," should read --the--; and
line 62, "are" should read --is--.
Column 6,
line 11, "on" should be deleted;
line 31, "of" should read --of a--; and
line 57, "operator" should read --operator,--, and
"of" (last occurrence) should read --by--.

UNITED STATES PATENT AND TRADEMARK OFFICE

CERTIFICATE OF CORRECTION

PATENT NO. : 5,563,696

DATED : October 8, 1996

INVENTOR(S) : JIRO FUTAGAWA, ET AL.

It is certified that error appears in the above-indentified patent and that said Letters Patent is hereby corrected as shown below:

Column 7,
line 5, "properly" should read --property--; and
line 65, "member;" should read --member; and--.

Column 9,
line 5, "detects" should read --detect--.

Column 10,
line 4, "detects" should read --detect--.

Signed and Sealed this

Twenty-ninth Day of April, 1997

*Attest:*

*Attesting Officer*

BRUCE LEHMAN

*Commissioner of Patents and Trademarks*